US005090862A

United States Patent [19]

Lee

[11] Patent Number: 5,090,862

[45] Date of Patent: Feb. 25, 1992

[54] MULTI-LEVEL VEHICLE PARKING SYSTEM

[76] Inventor: Shui M. Lee, No. 160, Sec. 1, Tai Yuan Rd., Taichung, Taiwan

[21] Appl. No.: 611,536

[22] Filed: Nov. 13, 1990

[51] Int. Cl.[5] ..... E04H 6/12

[52] U.S. Cl. ..... 414/261; 52/30; 187/8.41; 187/95

[58] Field of Search ..... 414/227, 228, 252, 261, 414/263, 264; 52/27, 29, 30, 236.2, 236.3; 187/8.41, 95

[56] References Cited

U.S. PATENT DOCUMENTS 1,772,110 8/1930 Randle ..... 414/228
3,290,837 12/1966 Weston ..... 52/30
4,023,687 5/1977 Salloum ..... 414/263 X
4,976,580 12/1990 Knakrick ..... 414/263 X

FOREIGN PATENT DOCUMENTS 1112240 3/1956 France ..... 414/227
771399 4/1957 United Kingdom ..... 52/30

*Primary Examiner*—David A. Bucci
*Attorney, Agent, or Firm*—Litman, McMahon & Brown

[57] ABSTRACT

A multi-level structure includes a number of parking levels, each level defines a number of parking stations which are arranged circularly. Four elevators are provided in a middle portion of the structure, each of the elevators is vertically movable in order to transfer vehicles to any of the levels. Each elevator can transfer two vehicles so that eight vehicles can be transferred by the four elevators at a time and so that the elevators can transfer vehicles in a fast speed.

2 Claims, 4 Drawing Sheets

MULTI-LEVEL VEHICLE PARKING SYSTEM

BACKGROUND OF THE INVENTION

The present invention relates to a parking system, and more particularly to a multi-level vehicle parking system.

A conventional parking lot is disclosed in U.S. Pat. No. 2,691,448 to Lontz in title of "Automatic Materials Handling System". This type of parking lot comprises a plurality layers of parking units and an elevator for transferring automobiles to one of the layers. Since there is only one elevator which can transport only one vehicle at a time, the transferring and handling speed of the automobiles is slow so that the automobiles which are going to be parked in this system are required to wait in line.

The present invention has arisen to mitigate and/or obviate the afore-described disadvantages of the conventional parking lots.

SUMMARY OF THE INVENTION

The primary objective of the present invention is to provide a multi-level vehicle parking system which can transfer automobiles in a fast speed.

In accordance with one aspect of the invention, there is provided a vehicle parking system including a multi-level structure which has a number of parking levels and which is cylindrical. Each level defines a number of parking stations arranged circularly. Four elevators are provided in the middle portion of the structure, each elevator is vertically movable in order to transfer vehicles to any of the levels. A post is provided in a center of the structure. Four beams are provided on the corners of the elevators. A number of rollers are provided between every elevator and the post, and are provided between every elevator and the beams for facilitating a vertical movement of the elevators. Two pairs of radially separated grooves are formed in the floor of each elevator. Each pair of the grooves have one groove closer to the post than the other groove. A stop is provided to slide along each of the grooves and is movable to a position behind the wheels of the vehicle so as to prevent the vehicle from moving rearward. Each elevator can transfer two vehicles so that eight vehicles can be transferred by the four elevators at a time and so that the multi-level vehicle parking system can transfer vehicles in a fast speed.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
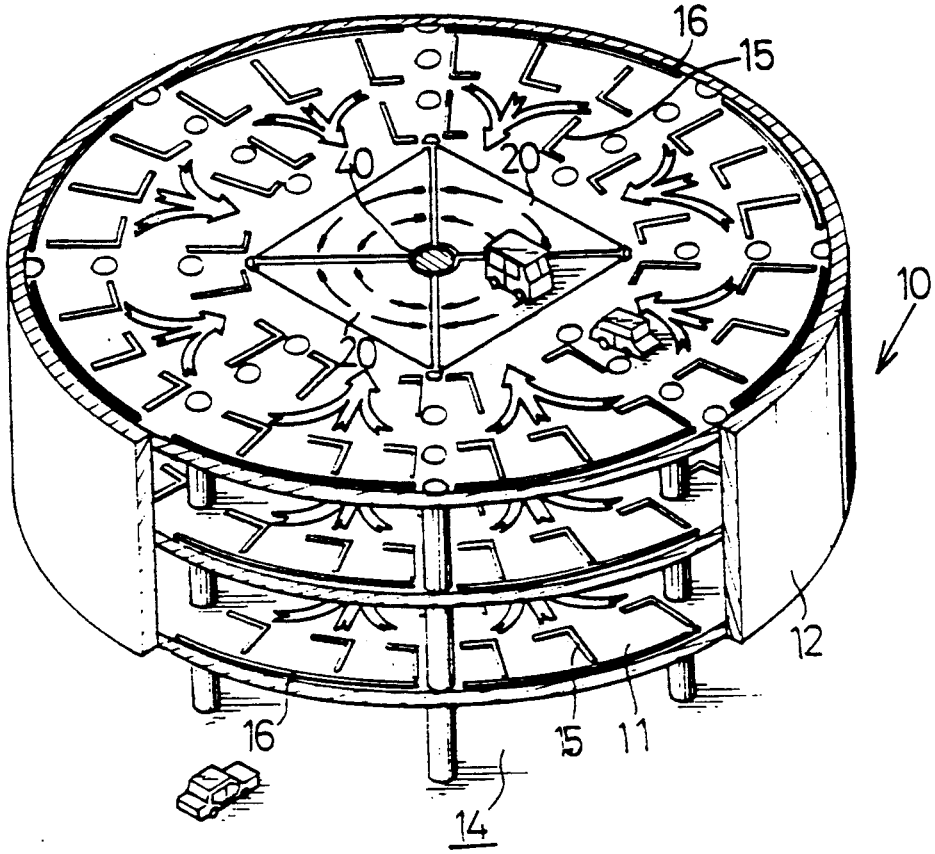
FIG. 1 is a perspective view of a multi-level vehicle parking system in accordance with the present invention, in which part of the wall of the parking system is cut for clearly illustration purposes.
Figure 2:
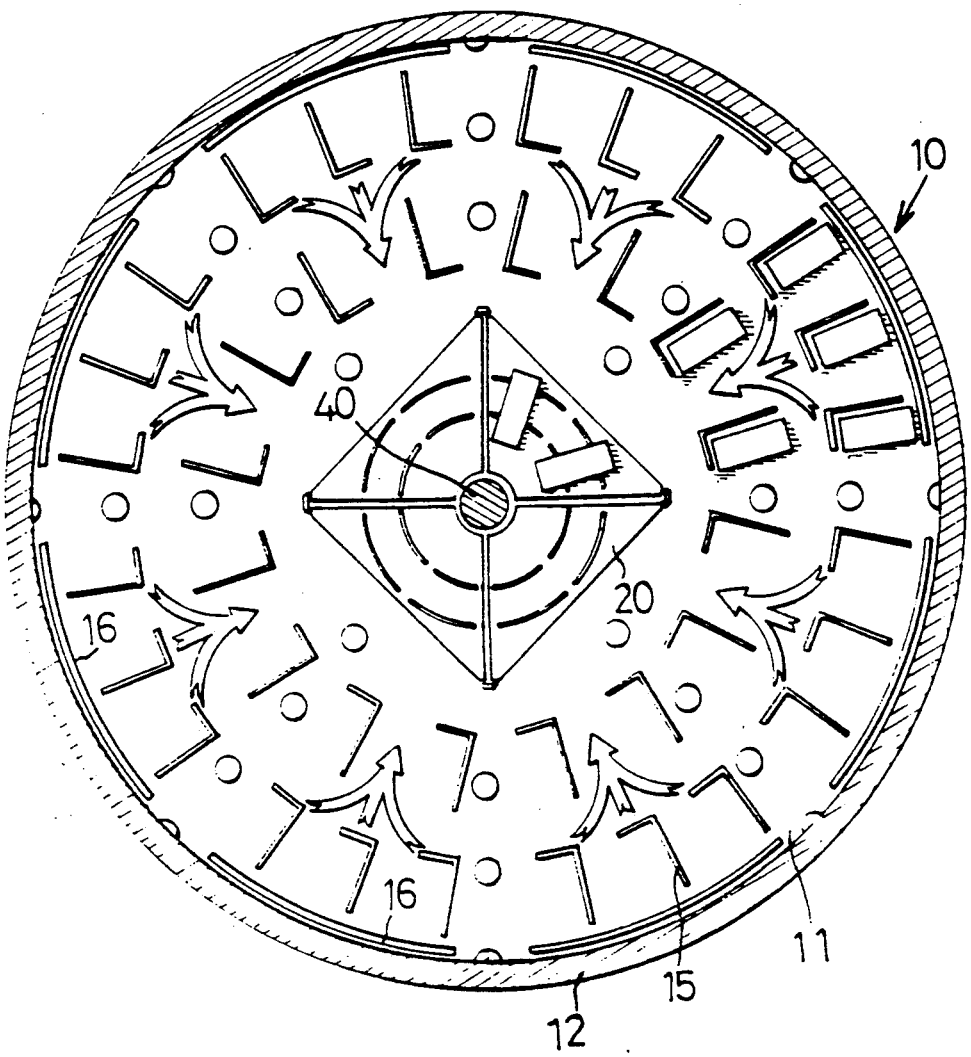
FIG. 2 is a plane view of one layer of the vehicle parking system.

Referring to the drawings and initially to FIGS. 1 and 2, a multi-level vehicle parking system in accordance with the present invention is substantially cylindrically shaped and comprises a plurality of different levels 11 such as the different floors in a structure 10 which has a cylindrical outer wall 12 provided on an outer peripheral surface thereof; and four elevators 20 provided in the middle portion of the structure 10, each of the elevators 20 is vertically movable in order to transfer the vehicles to any level.

As can be seen in FIG. 1, three parking levels 11 are shown above ground level. The ground level referred to is the level at which cars enter the garage, and this is indicated at 14. The ground level 14 has no outer wall so that the cars may enter the garage. Each level 11 includes a plurality of parking stations 15 arranged circularly in two rows. Each parking station 15 is represented by a letter "L" drawn on the floor. Eight curbs 16 which substantially form a circle are formed on an outer peripheral edge of each level 11. The curbs 16 are provided to alert the drivers that the vehicles have been moved to a rearmost position so that the driver can stop the vehicle and so that the vehicles are prevented from smashing into the outer wall 12.

Figure 3:
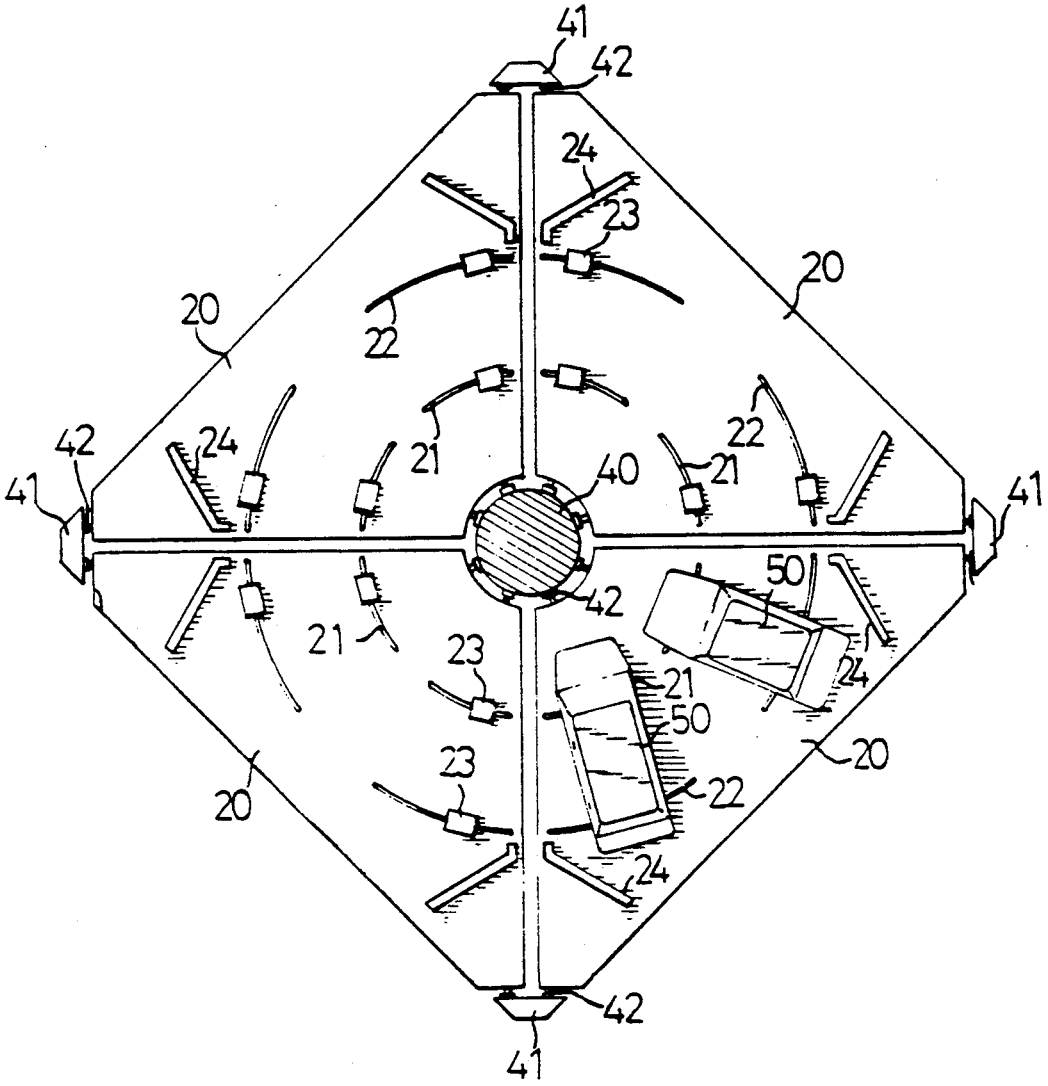
FIG. 3 is an enlarged plane view of the elevators.
Figure 4:
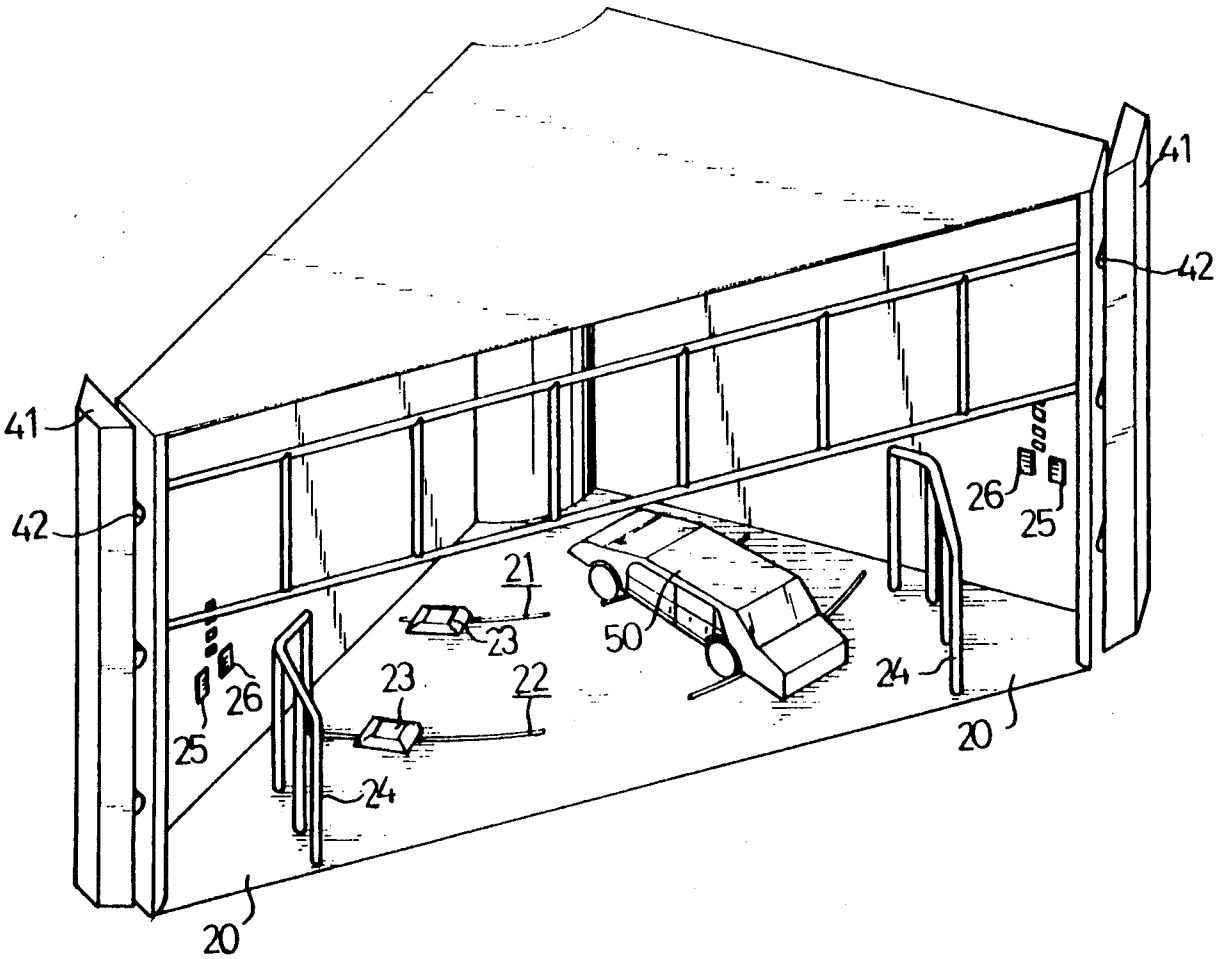
FIG. 4 is a perspective view illustrating one of the elevators.

Referring next to FIGS. 2 and 3, illustrated are the elevators 20 for transferring vehicles. As shown in the drawings, each of the four elevators 20 is substantially triangular, and the four elevators 20 altogether form a rectangle. The elevators 20 are provided in the middle portion of the structure 10. A post 40 is provided in the center of the structure 10. Four beams 41 are provided on the corners of the rectangle formed by the elevators 20. A plurality of rollers 42 or the like are provided between every elevator 20 and the post 40 and between every elevator 20 and the beams 41 for facilitating the vertical movement of the elevators 20. Two pairs of radially separated and curved grooves 21, 22 are formed in the floor of each of the elevators 20, in which the groove 21 of each pair of the grooves is closer to the post than the other groove 22. The distance between each pair grooves 21, 22 is equal to the distance between the front wheels and the rear wheels of the vehicle. A stop 23 is coupled to each groove 21, 22 and is slidable along the respective groove 21, 22. When a vehicle 50 moves into the elevator 20 beyond the grooves 21, 22, the stops 23 can be moved behind the wheels of the vehicle 50 so as to avoid the vehicle 50 from moving rearward. Each elevator 20 can transfer two vehicles 50 at a time. Two balustrades 24 and two pairs of buttons 25, 26 for controlling the elevator 20 are provided on both sides of each elevator 20. The balustrades 24 are provided for safety purposes. The drivers may hold the balustrades 24 when the elevator 20 moves.

Accordingly, each elevator 20 of the vehicle parking system in accordance with the present invention can transfer two vehicles at a time. Therefore, eight vehicles can be transferred by the four elevators at a time so that the vehicles can be transferred in a fast speed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A multi-level vehicle parking system comprising:

a multi-level structure including a plurality of parking levels, said structure being substantially cylindrical having an outer wall provided on an outer peripheral surface thereof, each parking level defining a plurality of parking stations which are arranged circularly, a plurality of curbs which altogether form a circle being formed on an outer peripheral edge of each of said parking levels, said curbs being provided to alert drivers of said vehicles so that said drivers may feel that the vehicles have been moved to a rearmost position in order that said drivers can stop said vehicles and so that said vehicles are prevented from smashing into said outer wall;

four elevators being provided in a middle portion of said structure, each of said elevators being triangular and being vertically movable in order to transfer vehicles to any of said parking levels, said elevators altogether forming a rectangle which has four corners, a post being provided in a center of said structure, a beam being provided on each of said corners of said rectangle formed by said elevators, a plurality of rollers being provided between every elevator and said post and being provided between every elevator and said beams for facilitating a vertical movement of said elevators, two pairs of radially separated and curved grooves being formed in a floor of each of said elevators, each pair of said grooves having one groove closer to said post than the other groove, a distance between each pair of said grooves being substantially equal to a distance between a front wheel and a rear wheel of said vehicle, a stop being coupled to and being slidable along each of said grooves;

and when said vehicle moves into one of said elevators, said stops can be moved behind said front wheel and said rear wheel of said vehicle so as to prevent said vehicle from moving rearward, each elevator can transfer two vehicles at a time so that eight vehicles can be transferred by said four elevators at a time and so that said multi-level vehicle parking system can transfer vehicles in a fast speed.

2. A vehicle parking system according to claim 1, two balustrades and two pairs of buttons for controlling said elevator are provided on both sides of each of said elevators, said balustrades are provided for safety purposes so that the drivers may hold said balustrades when said elevator moves.

* * * * *